United States Patent [19]

Maa et al.

[11] Patent Number: 4,824,558

[45] Date of Patent: Apr. 25, 1989

[54] COAL LIQUEFACTION PROCESS WITH METAL/IODINE COCATALYST

[75] Inventors: Peter S. Maa, Baton Rouge, La.; Lonnie W. Vernon, Baytown, Tex.; William E. Winter; Gopal H. Singhal, both of Baton Rouge, La.

[73] Assignee: Exxon Research and Engineering Company, Florham Park, N.J.

[21] Appl. No.: 93,376

[22] Filed: Sep. 4, 1987

[51] Int. Cl.[4] ..... C10G 45/00; C10G 45/04

[52] U.S. Cl. ..... 208/420; 208/421

[58] Field of Search ..... 208/419, 435, 420, 431, 208/428, 421, 115, 110, 116

[56] References Cited

U.S. PATENT DOCUMENTS

| | | | |
|---|---|---|---|
| 1,898,965 | 2/1933 | Spilker et al. | 208/435 |
| 4,077,807 | 3/1978 | Aldridge et al. | 208/420 X |
| 4,250,015 | 2/1981 | Yang et al. | 208/419 |
| 4,338,184 | 7/1982 | Maa et al. | 208/419 X |
| 4,347,116 | 8/1982 | Whitehurst et al. | 208/419 X |
| 4,424,110 | 1/1984 | Beavden, Jr. et al. | 208/420 X |
| 4,457,835 | 7/1984 | Kukcs | 208/251 M |

FOREIGN PATENT DOCUMENTS

| | | | |
|---|---|---|---|
| 20279 | 11/1935 | Australia | 208/419 |
| 064877 | 1/1979 | Japan | 208/419 |
| 493307 | 10/1938 | United Kingdom | 208/419 |

*Primary Examiner*—Glenn Caldarola
*Attorney, Agent, or Firm*—Roy J. Ott

[57] ABSTRACT

An improved process for hydroconverting carbonaceous material wherein the hydroconversion is accomplished in the presence of a sulfide of tin or tin and at least one metal selected from the Group of metals consisting of the Groups IV-B, V-A, VI-A, VII-A and Group VIII-A metals of the Periodic Table of the Elements and in the presence of iodine. The tin and any other metal may be added directly as the sulfide or as a soluble precursor that will either decompose or be converted to the sulfide. The iodine may be added directly as iodine, hydrogen iodine or as a precursor which will decompose to yield either iodine or hydrogen iodide. The hydroconversion is also accomplished in the presence of hydrogen. The tin sulfide when used either alone or in combination with a sulfide of at least one other metal selected from the Group of metals consisting of Groups IV-B, V-A, VI-A, VII-A and VIII-A of the Periodic Table of the Elements when used with iodine surprisingly increases the yield of gasoline boiling range product from the hydroconversion or liquefaction process. When tin sulfide is used in combination with at least one other metal sulfide, the increase in the yield of gasoline boiling range product is even more surprising.

34 Claims, 2 Drawing Sheets

FIG. 2
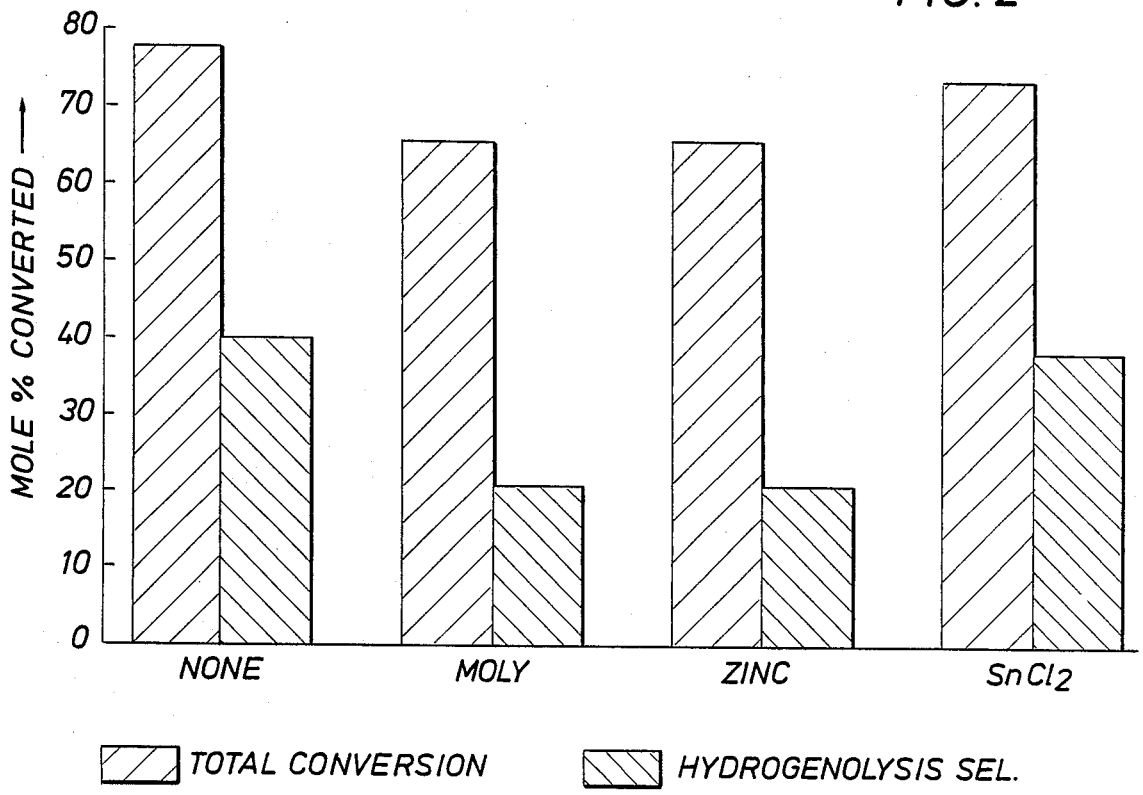
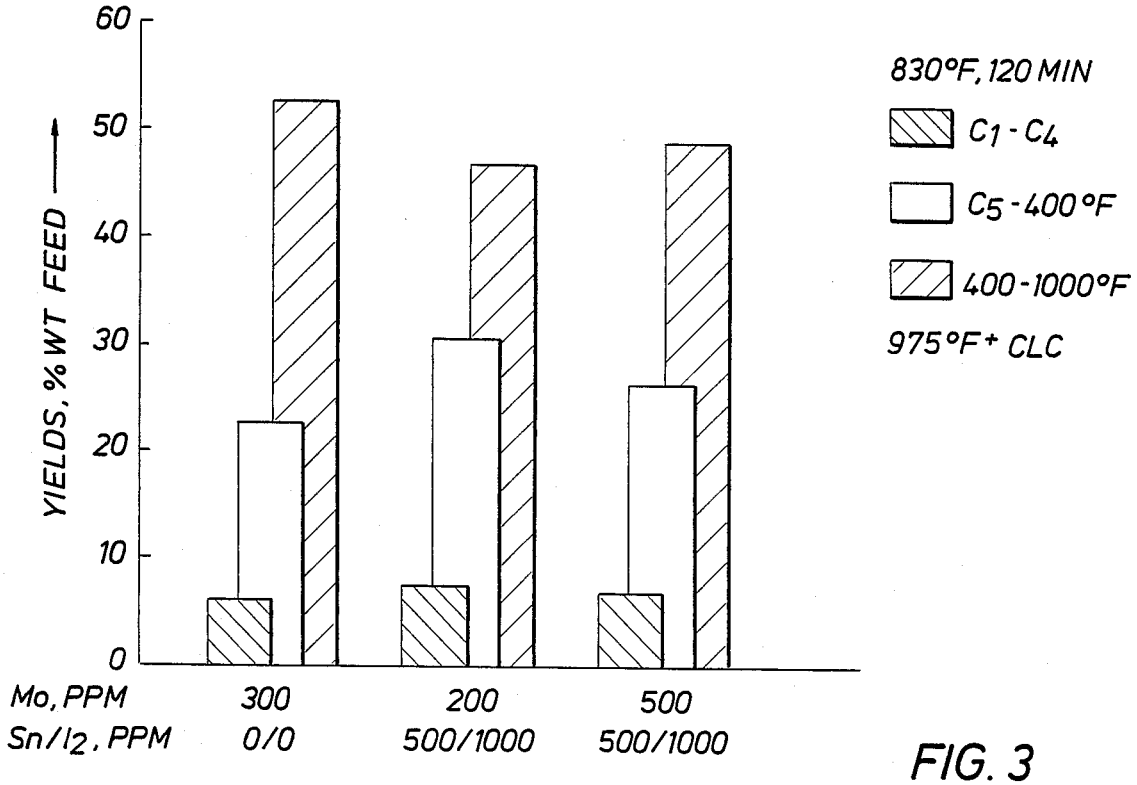
FIG. 3

COAL LIQUEFACTION PROCESS WITH METAL/IODINE COCATALYST

BACKGROUND OF THE INVENTION

This invention relates to an improved process for hydroconverting carbonaceous materials to lower molecular weight products. More particularly, this invention relates to an improved catalytic process for hydroconverting carbonaceous materials to lower molecular weight, liquid products.

Heretofore, several catalytic processes for hydroconverting carbonaceous materials such as petroleum residuum, coal, lignite, peat and the like to lower molecular weight products have been proposed. In general, the lower molecular weight products may be either gaseous or liquid or a mixture of both. The production of lower molecular weight liquid products is, however, particularly desirable since liquid products are more readily stored and transported and, often, are conveniently used as motor fuels.

Heretofore, a large number of suitable catalysts have been identified as useful in such hydroconversion processes. For example, metal sulfides and oxides and mixtures thereof have been particularly useful as catalysts in such processes. Moreover, a host of catalyst precursors; i.e., compounds that will either decompose or are readily converted to an active sulfide or oxide form, have been identified. Such precursors include metal complexes such as transition metal hydrocarbyl-substituted dithiocarbamates, transition metal naphthenates and phospho-transition metal acids and inorganic compounds such as ammonium salts of transition metals. In general, the precursors used have either been soluble to some extent in the reaction medium itself or in a solvent which is added to the reaction medium. The solvents heretofore employed have been both organic and inorganic.

Heretofore, it has also been proposed to use iodine to enhance the hydroconversion of carbonaceous materials such as coal in thermal operations. In processes of this type, relatively high concentrations of iodine are employed. The enhancement of the hydroconversion is believed to be due to the formation of HI from $I_2$ in the presence of hydrogen. The HI is then instrumental in the formation of a hydrogen radical (H.) which participates in the hydrogenolysis reaction to break bonds in the carbonaceous material which normally cannot be broken thermally to form a lighter (lower molecular weight) product.

Notwithstanding that a large number of suitable catalysts for the hydroconversion of carbonaceous materials have been identified and, notwithstanding that the yield of liquid product has been relatively high, when compared to liquid yields in thermal operations, with the better of these catalysts particularly catalysts comprising molybdenum, the yield of naphtha boiling range material which may be used directly or upgraded and then used as motor gasoline has been low. As a result, it has, heretofore, been necessary to further process the higher boiling liquid products such as middle distillate and vacuum gas oil to further increase the yield of gasoline range boiling liquid products. This additional treatment, however, further complicates the hydroconversion process, significantly increases the molecular hydrogen required to effect the conversion and significantly increases the overall cost of the operation. Moreover, the overall quality of the liquid product from a catalytic hydroconversion has, in general, been poor due primarily to its higher molecular weight and lower hydrogen content. The need, then, for an improved catalytic process which will yield improved quality liquid products and higher yields of gasoline boiling range liquid is believed to be readily apparent.

SUMMARY OF THE INVENTION

It has now been discovered that the foregoing and other disadvantages of the prior art catalytic processes can be avoided, or at least reduced, with the method of the present invention and an improved process for hydroconverting carbonaceous materials to lower molecular weight, liquid products provided thereby. It is, therefore, an object of this invention to provide an improved catalytic process for the hydroconversion of carbonaceous materials to lower molecular weight, liquid products. It is another object of this invention to provide such a catalytic process wherein the quality of the liquid product is improved. It is still a further object of this invention to provide such a catalytic process wherein the yield of liquid product boiling in the motor gasoline range is increased. The foregoing and other objects and advantages will become apparent from the description set forth hereinafter and from the drawings appended thereto.

In accordance with the present invention, the foregoing and other objects and advantages are accomplished by converting a carbonaceous material, at least in part, to lower molecular weight, liquid products in the presence of tin sulfide either alone or in combination with one or more other metal sulfides of a metal or metals from any one of Groups IV-B, V-A, VI-A, VII-A and VIII-A of the Periodic Table of the Elements, which tin sulfide and one or more other metal sulfides are formed either prior to or during the conversion process, and in the presence of iodine and molecular hydrogen at an elevated temperature and pressure. In general, the tin sulfide or mixture of tin sulfide and one or more other metal sulfides may be used at any of the concentrations known heretofore to be effective for such hydroconversion operations. The iodine, on the other hand, will be used at concentrations significantly below those heretofore contemplated and particularly will be used at a concentration within the range from about 10 ppm to about 5000 ppm,by weight, based on a dry, ash-free (DAF) carbonaceous material basis.

BRIEF DESCRIPTION OF THE DRAWINGS

FIG. 2 is a series of Bar Graphs comparing the effect of certain compounds on the cracking and hydrogenation of dibenzyl with the results obtained in the absence of such compounds; and FIG. 3 is a series of Bar Graphs comparing the yields of certain gaseous and liquid products when a Cold Lake crude oil residuum was hydroconverted with two different catalysts within the scope of the present invention with the yields obtained when the hydroconversion is completed with a molybdenum sulfide catalyst.

DETAILED DESCRIPTION OF THE INVENTION

Figure 1:
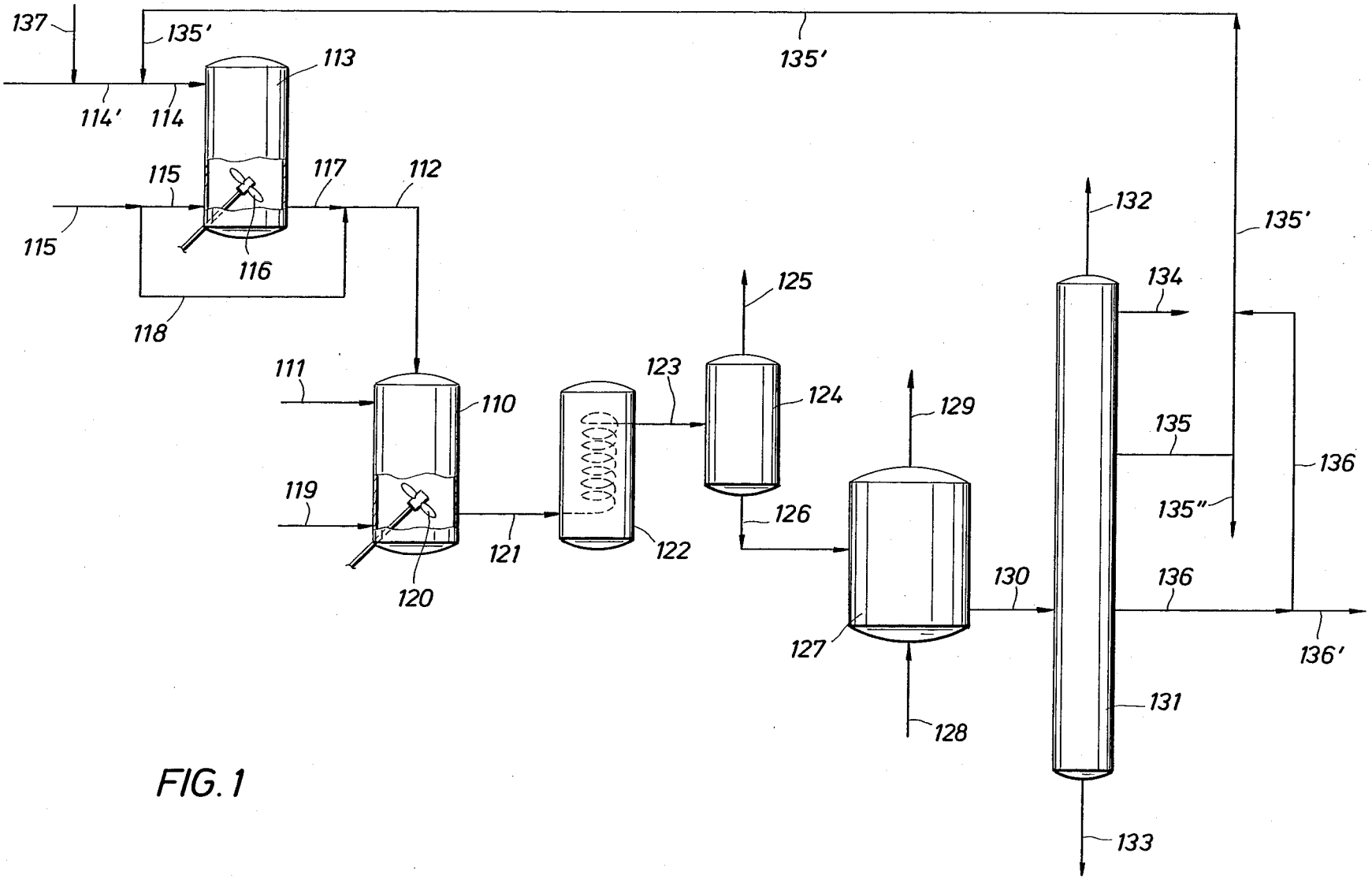
FIG. 1 is a schematic flow diagram of a process within the scope of the present invention.

As indicated supra, the present invention relates to an improved catalytic process for hydroconverting carbonaceous materials to lower molecular weight, liquid products wherein tin sulfide either alone or in combination with one or more other metal sulfides comprising a metal selected from any one of Groups IV-B, V-A, VI-A, VII-A and VIII-A of the Periodic Table of the Elements is used in combination with iodine as a catalyst. As also indicated supra, the conversion of the carbonaceous material will take place in the presence of molecular hydrogen at an elevated temperature and pressure. The carbonaceous material may be combined with a suitable diluent or solvent during the conversion.

In general, the method of the present invention can be used to convert any non-gaseous carbonaceous material to lower molecular weight products. The carbonaceous material may, then be either normally solid or normally liquid and may be either solid or liquid at conversion conditions. Suitable normally solid carbonaceous materials include, but are not necessarily limited to, coal, trash, biomass, shale oil, tar sand bitumen and the like. This invention is partcularly useful in the catalytic liquefaction of coal and may be used to liquefy any of the coals known in the prior art including bituminous coal, subbituminous coal, lignite, peat, brown coal and the like. These materials are, at least initially, solid at conversion conditions. Suitable carbonaceous materials which may be normally liquid, include, but are not necessarily limited to, carbonaceous materials remaining after a crude oil has been processed to separate lower boiling constituents, such as petroleum residuals. In general, petroleum residuals will have an initial boiling point within the range from about 650° F. to about 1050° F. The petroleum residuals will, generally, be liquid at the conditions used to effect the catalytic conversion in the improved process of this invention. The improved process of this invention is also particularly applicable to the conversion of petroleum residuals from a vacuum distillation column having an initial boiling point within the range of from about 850° F. to about 1050° F.

In general, and when a carbonaceous material, which is solid at the conversion conditions, is converted in the improved process of this invention, the same will, generally, be ground to a finely divided state. The particular particle size or particle size range actually employed, however, is not critical to the invention and, indeed essentially any particle size can be employed. Notwithstanding this, preferably, the solid carbonaceous material which is liquefied in accordance with this invention, will be ground to a particle size of less than ¼ inch and preferably to a particle size of less than about 8 mesh (N.B.S. sieve size).

After the solid carbonaceous material has been sized, the same will, generally, be slurried with a suitable diluent or solvent and combined with a suitable catalyst or catalyst prescusor. Normally, the ratio of solvent or diluent to solid carbonaceous material (on a moisture-free basis) in the slurry will be within the range from about 0.8:1 to about 10:1 on a weight basis. Ratios in a higher portion of this range will be required when significant amounts of bottoms are recycled to increase the active catalyst concentrations. The higher solvent ratio will, of course, be required to insure that the slurry may be transported by pumping or the like.

In general, any of the solvents or diluents known in the prior art to be useful in the liquefaction of coal and similar solid carbonaceous materials may be used as the solvent or diluent in the present invention. The solvent or diluent may be a pure compound or a mixture of compounds such as would be contained in various hydrocarbon distillate fractions. The solvent may be a compound capable of donating hydrogen at liquefaction conditions or may be a mixture comprising one or more such compounds. Compounds which will donate hydrogen during liquefaction are believed well known in the prior art and many are described in U.S. Pat. No. 3,867,275. These include the dihydronaphthalenes, the $C_{10}$–$C_{12}$ tetrahydronaphthalenes, the hexahydrofluorenes, the dihydro-, tetrahydro-, hexahydro- and octahydrophenanthrenes, the $C_{12}$–$C_{13}$ acenapthenes, the tetrahydro-, hexahydro- and decahydropyrenes, the di-, tetra- and octahydroanthracenes and other derivatives of partially saturated aromatic compounds. Particularly effective mixed solvents include creosote oil and distillate fractions separated from the solid carbonaceous material liquid product which may be optionally partially hydrogenated prior to use. Particularly useful distillate fractions include those having an initial boiling point from within the range from about 350° F. to about 750° F. and a final boiling point within the range from about 700° F. to about 1100° F. It is, of course, particularly advantageous to use the vacuum gas oil distillate fraction as the diluent or solvent since recycle of this distillate fraction will increase the yield of lower boiling liquid product, permit recycle of the vacuum gas oil effectively to extinction and, as indicated more fully hereinafter, reduce the amount of make-up iodine required to maintain any given iodine concentration during the hydroconversion.

In general, and when a normally liquid carbonaceous material or a carbonaceous material which is normally solid but which will melt at a temperature below the hydroconversion temperature is hydroconverted in the process of this invention, either such carbonaceous material may be combined with a suitable solvent or diluent prior to the hydroconversion. Suitable solvents or diluents include those solvents or diluents identified above as useful with solid carbonaceous materials. The use of a solvent or diluent with such carbonaceous materials is not, however, necessary when such carbonaceous materials are processed. It may, however, be beneficial to heat and stir such carbonaceous materials to insure melting of such carbonaceous materials and good distribution of the catalyst mixture or precursors thereof throughout the feedstock.

In general, tin sulfide or any tin compound that will convert to a tin sulfide, when sulfur in some form is present, may be used as a source of tin in the process of this invention. In general, the tin compound may be added directly to the carbonaceous material in its existing state; i.e., as a liquid or solid or the same may be first dissolved or dispersed in a suitable solvent or diluent and then combined with the carbonaceous material. Tin compounds which may be used as a source of tin in the process of this invention include inorganic salts such as stannous chloride ($SnCl_2$),stannic chloride ($SnCl_4$) and the like and organometallic complexes such as the monohydrocarbyland dihydrocarbyl-substituted and the iodo-hydrocarbyl-substituted dithiocarbamates of tin, wherein the hydrocarbyl substitution may contain from 1 to about 18 carbon atoms, tin naphthanates, tin carboxylates and the like. Suitable solvents for tin sulfide and the inorganic salts useful in the method of this invention include water, alcohol and the like. Useful solvents for the organometallic complexes include those carbonaceous materials which may be normally liquid or liquid at the hydroconversion conditions used in the present invention as well as those solvents and diluents heretofore identified as useful with feedstocks which are hydroconverted in the process of this invention.

While the inventors do not wish to be bound by any particular theory, it is believed that the increased yield of lower molecular weight liquid products, particularly naphtha boiling range products, is due, in large part at least, to the increased cracking activity exhibited by tin sulfide when compared to the more conventional hydrogenation catalysts heretofore used in carbonaceous material liquefaction processes. Moreover, the Yield of such lower molecular weight liquid products is even further increased when at least a portion of the vacuum gas oil boiling range product is recycled to the hydroconversion zone, as well as when at least a portion of the normally solid bottoms product, particularly when a normally solid carbonaceous material is hydroconverted, is recycled to the hydroconversion zone. This increased yield is, of course, also believed to be due to the increased cracking activity of the tin sulfide component used in the catalyst composition of this invention. Further, the apparent cracking activity of tin sulfide is also temperature sensitive and drastically increases at temperatures above about 820° F. Operation at temperatures in excess of about 820° F., then, drastically increases the yield of lower boiling products and further improves the selectivity in product distribution toward naphtha boiling range liquid products.

While the use of tin sulfide alone in combination with iodine constitutes a significant improvement over the catalytic hydroconversion processes heretofore proposed, especially when viewed from the standpoint of naphtha boiling range liquid product, it has surprisingly been discovered that the yield of such naphtha boiling range liquid product can be even further increased by using tin sulfide in combination with one or more other metal sulfides. Moreover, this even further increase in the yield of naphtha boiling range liquid product is obtained without any significant increase in the yield of gaseous ($C_1$–$C_4$ hydrocarbons) products. Use of tin sulfide in combination with one or more other metal sulfides and in the presence of iodine, then, even further improves the selectivity of the product distribution toward the production of a naphtha boiling range liquid product.

In general, and when tin sulfide is used in combination with one or more other metal sulfides, any metal sulfide known to exhibit hydrogenation activity may be used in the improved process of this invention. Such metal sulfides include the sulfides of the metals of Group IV-B, V-A, VI-A, VII-A and VIII-A of the Periodic Table of the Elements. The other metal sulfide or sulfides may be added directly to the slurry as a preformed metal sulfide but preferably a readily dispersible or soluble precursor will be added to the slurry. Suitable precursors which will convert the corresponding metal sulfides under process conditions or as said precursors are heated to process conditions include: (1) inorganic metal compounds such as metal halides, oxyhalides, hydrated oxides, heteropoly acids (e.g., phosphomolybdic acid and molybdosilic acid) and the like; (2) metal salts and metal complexes of organic acids such as the cyclic, alicyclic aliphatic and aromatic carboxylic acids containing two or more carbon atoms (e.g., metal salts of napthenic acid, toluic acid, toluenesulfonic acid, carbamic acid, thio- and dithiophosporic acids, thio- and dithiocarbamic acids, xanthic acids and the like); (3) organometallic compounds such as metal chelates (e.g., metal chelates of 1,3-diketones, metal chelates of alkyl diamines and the like); metal complexes such as metal complexes of phthalocyanides, carboxylic acids and the like; (4) metal salts of organic amines such as metal salts of aliphatic amines, aromatic amines and quartinary ammonium compounds and the like.

As indicated previously, the metal constituent of the other metal sulfide or sulfides or precursor thereof is selected from the Group consisting of Groups IV-B, V-A, VI-A, VII-A and VIII-A of the Periodic Table of the Elements, and mixtures thereof, which Periodic Table of the Elements was published and copyrighted by E. H. Sargent and Company in 1980. Useful metals include, but are not necessarily limited to, chromium, molybdenum, tungsten, iron, cobalt nickel and the noble metals including platinum, iridium palladium osmium ruthenium and rhodium. The preferred metal sulfides or precursors thereof are the oil soluble compounds containing a metal selected from the group consisting of molybdenum and iron. Most preferably, the metal sulfide will be provided with an oil soluble metal compound comprising molybdenum. Preferred precursors of the other metal sulfide or metal sulfides include the metal salts and metal complexes of aliphatic (straight and branched chain), cyclic, alicyclic, aromatic and aliaryl carboxylic acids, heteropoly acids, hydrated oxides, carbonyls, phenolates, organo amine salts and dithiocarbamates. More preferred types of other metal sulfide compound precursors are the heteropolyacids, dithiocarbamates and naphthenates. The most preferred compounds are phosphomolybdic acid, dithiocarbamates of molybdenum, molybdenum naphthenate and the like. The preferred, more preferred and most preferred metal sulfide precursors may be dissolved or dispersed in a suitable solvent or diluent and converted in situ to the active catalyst species as the slurry is heated to hydroconversion temperature.

In general, most of the feedstocks subjected to hydroconversion in the process of this invention will contain a sufficient amount of sulfur to effect the conversion of any tin compound and any other metal compound that may be used to the corresponding tin or other metal sulfide. Moreover, certain of the precursors, such as the dithiocarbamates of tin or any other metal, will contain sufficient sulfur to facilitate the conversion of the tin or the other metal to the corresponding sulfide. In those cases, however, where neither the feedstock nor the tin or other metal precursor contain a sufficient amount of sulfur to effect the desired conversion, it will be necessary to either use tin sulfide either alone or in combination with one or more other metal sulfides directly or to contact the precursors with sulfur either prior to or during the hydroconversion step. In this regard, and as is well known in the prior art, a broad range of sulfur compounds, including elemental sulfur, such as $CS_2$, $H_2S$, various mercaptans and the like may be used to effect such conversion at temperatures, generally, within the range from about 500° F. to about 1000° F.

In general, the tin sulfide or tin sulfide precursor will be combined with the carbonaceous material at a concentration within the range from about 10 ppm to about 5000 ppm, by weight, tin, based on dry, ash-free carbonaceous material. Preferably, the tin sulfide or tin sulfide precursor will be combined such that the concentration of tin is within the range from about 100 to about 2000 ppm, by weight, based on dry, ash-free carbonaceous material. When a tin sulfide precursor is used, the same may be added to the solvent and then combined with the carbonaceous material or the tin sulfide precursor may be added or combined with the carbonaceous material and then the solvent.

In general, and when tin is used in combination with one or more other metals, the tin sulfide or tin sulfide precursor as well as any other metal sulfide or metal sulfide precursor will each be combined with the carbonaceous material at a concentration within the range from about 10 ppm to about 5000 ppm, by weight, metal, based on dry, ash-free carbonaceous material. Preferably, the sulfides or sulfide precursors will each be combined such that the concentration of each metal is within the range from about 100 to about 2000 ppm, by weight, based on dry, ash-free carbonaceous material. In general, tin will be combined with the one or more other metals, at an Sn/M weight ratio within the range from about 0.1:1 to about 10:1. When a sulfide precursor is used, the same may be added to the solvent and then combined with the carbonaceous material or the catalyst precursor may be added or combined with the carbonaceous material and then the solvent.

In general, the iodine may be added directly as $I_2$ or HI. Alternatively, the iodine may be added as a compound comprising iodine which will decompose to yield either iodine or hydrogen iodine at a temperature equal to or below the hydroconversion temperature actually employed. As indicated supra, the iodine may be contained in the same precursor compound as contains the tin, such as in an iodosubstituted dithiocarbamate of tin. Suitable compounds that will thus decompose include, but are not necessarily limited to, tetrabutylammonium iodide, 2-propanol-1,3-bis(dimethylamino)iodoacetic acid, 2-iodoaniline, 1-iodobutane, dimethyl iodide, 1-iodonaphthalene, iodoethane, 2-iodotoluene and the like. In general, the iodine or iodine precursor may be added to the slurry of carbonaceous material or the same may be separately fed to the hydroconversion reactor. In general, a sufficient amount of iodine or iodine precursor will be added to provide from about 10 ppm to about 5000 ppm Iodine, by weight, based on dry, ash-free carbonaceous material. Preferably, a sufficient amount of iodine or iodine precursor will be added to provide from about 100 ppm to about 2000 ppm Iodine, by weight, based on dry, ash-free solid carbonaceous material. Generally, the amount of iodine added will be controlled such that there is at least 0.5 parts, by weight, Iodine per part, by weight, of metal (tin plus any other metal that may be present) in the catalyst composition and generally the iodine to total metals weight ratio will be within the range from about 0.5:1 to about 10:1.

After the carbonaceous material has been dispersed or slurried in a suitable solvent or diluent, when a diluent of solvent is used, the slurry or the carbonaceous feedstock, either with or without the tin sulfide or tin sulfide precursor as well as any other metal sulfide or metal sulfide precursor that may be used and/or the iodine or iodine precursor, will be subjected to hydroconversion conditions. It will, of course, be appreciated that in those cases where the tin sulfide or tin sulfide precursor as well as any other metal sulfide or metal sulfide precursor that may be used and/or the iodine or iodine precursor are not added directly to the slurry prior to bringing the same to hydroconversion conditions any one or all of the tin sulfide or tin sulfide precursor as well as any other metal sulfide or metal sulfide precursor that may be used and the iodine or iodine precursor could be added separately to the reaction medium during hydroconversion. In any case, the hydroconversion will be accomplished in the presence of tin sulfide either alone or in combination with one or more other metal sulfides comprising one or more metals selected from Groups IV-B, V-A, VI-A, VII-A and/or Group VIII-A of the Periodic Table of the Elements, and in the presence of hydrogen and either iodine or hydrogen iodide. In general, the hydroconversion will be accomplished at a temperature within the range from about 500° F. to about 1000° F. and at a total pressure within the range of about 500 psig to about 7000 psig. As is well known in the prior art, solid carbonaceous materials are, generally, most effectively hydroconverted at temperatures within the range from about 700° F. to about 900° F., which range is preferred in the process of this invention. As indicated supra, and surprisingly, however, in the present case, most effective hydroconversion is accomplished when the hydroconversion reaction is completed at a temperature above about 820° F. It is, therefore, most preferred in the present invention that the hydrogenation reactions be completed at a temperature within the range from about 820° F. to about 860° F. In general, molecular hydrogen will be present during the conversion at partial pressures within the range from about 400 psig to about 5000 psig. In general, the conversion of the carbonaceous material might be accomplished either in a batch or continuous operation and in either a single stage or in a plurality of stages. In any case, the total nominal holding time at conversion conditions will, generally, range from about 10 minutes to about 600 minutes. Moreover, and while significant conversion will be realized when the catalyst concentration and the iodine concentration is maintained within the aforementioned ranges on a once through basis, the make-up catalyst and make-up iodine concentrations required to maintain these concentrations may be significantly reduced by recycling at least a portion of the normally solid bottoms product, containing tin, any other metal that may have been used and iodine species, and at least a portion of the vaccuum gas oil fraction of the liquid product which contain a substantial portion of the iodine, as solvent.

In general, the hydroconversion of the carbonaceous material will result in the production of a normally gaseous product, a normally liquid product and a normally solid bottoms product which will have characteristics similar to those of the feed material. As used herein, the recitation 'normally' means at standard temperature and pressure conditions. After the hydroconversion of the carbonaceous material is completed to the extent desired, the several products may be separated into the respective phases using conventional methods. The metal or metal compounds introduced as catalyst components will, in some form, generally, be contained in the normally solid bottoms product. The iodine, on the other hand, introduced as a cocatalyst or as a catalyst activator will, in some form, generally be contained partly in the vacuum gas oil portion of the liquid product; i.e., that portion having an initial boiling point within the range from about 600° F. to about 700° F., and partly in the normally solids bottom product.

In general, and when a plurality of conversion stages or zones are employed, the gaseous and lighter boiling liquid hydrocarbons will, generally, be separated between each stage. Normally, this separation will include all components having a boiling point below about 350° F. to about 450° F. Moreover, after the lower boiling point materials have been separated, portions of the remaining slurry could be recycled to any previous stage to increase the total conversion and the catalyst and cocatalyst concentrations in said stage. When a single conversion stage or zone is employed or after the final stage, when a plurality of conversion stages or zones is used, the product from the hydroconversion will, generally, be flashed to separate the gaseous and lower boiling materials and the remainder separated into at least three product streams. Moreover, in those operations wherein a solvent is used, this solvent will be separated from the normally liquid product. In this regard, and since about 40 wt % to 45 wt. % of the iodine will be contained in the liquid fraction having an initial boiling point within the range from about 600° F. to about 700° F., it is preferred, then, in the method of the present invention, to use at least a portion of that distillate fraction having an initial boiling point within the range from about 600° F. to about 700° F. and a final boiling point within the range from about 950° F. to about 1050° F. as solvent.

As is well known in the prior art, the normally gaseous product obtained from the hydroconversion may be upgraded to a pipeline gas or the same may be burned to provide energy for the conversion process. Alternatively, all or a portion of the normally gaseous product may be reformed to provide hydrogen for the hydroconversion process.

Similarly, the liquid product may be fractionated into essentially any desired product distribution and the various fractions thereof upgraded as desired using conventional technology. Generally, a naphtha or motor gasoline boiling range fraction will be recovered in an increased yield from the process of this invention and this fraction will be further processed to yield a high quality motor gasoline or similar fuel boiling in this range. Also, a middle distillate fraction may be separated from the liquid product and upgraded for use as a fuel oil or as a diesel fuel. A vacuum gas oil distillate fraction may also be recovered as a product but in a preferred embodiment of the present invention, this fraction will be recycled to extinction as solvent.

As is also well known in the prior art, the normally solid bottoms product may be gasified, depending upon its carbon content, to produce hydrogen for the hydroconversion process or be burned to provide heat for the hydroconversion process. In the case of relatively high carbon conversion during the hydroconversion, however, and particularly when the carbon content is too low to make either gasification or combustion feasible, the bottoms product may simply be disposed of as a waste material. In this case, all or a portion of the metal or metals used as catalyst as well as any iodine contained in the bottoms may be recovered in either an active or inactive form.

PREFERRED EMBODIMENT

In a preferred embodiment of the present invention, a coal will be hydroconverted or liquefied in the presence of both tin sulfide and molybdenum sulfide, molecular hydrogen and molecular iodine. It should be noted, however, that the Inventors believe that at least a portion of the molecular iodine will react with molecular hydrogen to produce hydrogen iodide, at least a portion of which may decompose to yield a hydrogen radical and, to the extent that this is true, the hydroconversion or liquefaction will be carried out in the presence of a hydrogen radical, molecular hydrogen and hydrogen iodide or a hydrogen radical, molecular hydrogen, hydrogen iodide and molecular iodine. In any case and in a preferred embodiment of the present invention, the hydroconversion will be completed at a temperature within a range from about 820° F. to about 860° F. and in the presence of molecular hydrogen at a partial pressure within the range from about 800 psig to about 2500 psig, most preferably 1350 psig to 2200 psig and at a total pressure within the range from about 1000 psig to about 3000 psig, most preferably at a total pressure within the range from about 1500 psig to about 2500 psig. In the preferred embodiment of this invention, tin, molybdenum and iodine will each be present at concentrations within the range from about 100 ppm to about 2000 ppm, by weight, based on dry, ash-free coal, most preferably tin, molybdenum and iodine will each be present at a concentration within the range from about 200 ppm to about 1500 ppm, by weight based on dry, ash-free coal. In a most preferred embodiment of the present invention, the weight ratio of iodine and tin plus molybdenum will be within the range from about 1:1 to about 5:1 and the weight ratio of tin to molybdenum will be within, the range from about 0.5:1 to about 5.0:1. Also in a preferred embodiment at least a portion of the liquid product having an initial boiling point within the range from about 600° F. to about 700° F. and a final boiling point within the range from about 950° F. to about 1050° F. will be recycled as solvent so as to reduce the amount of iodine that must be added from an extraneous source to achieve the desired hydroconversion concentration. Similarly, in a preferred embodiment, at least a portion of the normally solid bottoms product, which bottoms product will have an initial boiling point within the range from about 950° F. to about 1050° F., will be recycled so as to reduce the amount of metal or metals and to further reduce the amount of iodine that must be added from an extraneous source to achieve the desired hydroconversion concentration in each. In general, from about 50 wt % to about 90 wt % of the normally solid bottoms product will be recycled. This, then, would yield an initial weight ratio of solid carbonaceous material to recycle bottoms in the hydroconversion step within the range from about 0.5:1 to about 2:1. In a preferred embodiment of the present invention, from about 60 wt % to about 85 wt % of the normally solid bottoms product will be recycled and combined with solid carbonaceous material in the hydroconversion step. This, then, would yield an initial weight ratio of solid carbonaceous material to recycle bottoms in the preferred embodiment, within the range from about 0.8:1 to about 2.0:1.

While the improved process of the present invention may be practiced in either a batch or continuous operation and with either a single conversion zone or with a plurality of conversion zones, the improved process of this invention, will preferably, be practiced continuously in a single conversion zone. Moreover, in a preferred embodiment of the present invention, a distillate fraction comprising at least a portion of the iodine initially introduced will be used as solvent. As indicated more fully hereinafter, the iodine contained in the recycled solvent will be either in the form of iodine ($I_2$) or hydrogen iodide (HI) or in the form of a compound or complex with other organic molecules that will decompose to either yield iodine ($I_2$) or hydrogen iodide (HI) at the hydroconversion conditions employed. In those cases where the iodine is not thusly available in the recycled solvent, the recycle solvent may be separately treated to convert the iodine contained therein to such a form. Also in a preferred embodiment, a soluble tin sulfide precursor and a soluble molybdenum sulfide precursor will be used and both precursors will be incorporated into the slurry prior to heating the same to hydroconversion temperature. In a most preferred embodiment of this invention, a tin halide, particularly tin chloride, will first be dissolved in a solvent such as an alcohol and then incorporated into the process solvent. Also in a most preferred embodiment of this invention, an alkyl-substituted dithiocarbamate of molybdenum, wherein each of the alkyl substitutions comprise from about 1 to about 10 carbon atoms will be used as the molybdenum sulfide precursor and the dithiocarbamate will be incorporated into the process solvent by dissolving the same therein. In a preferred embodiment of the present invention, a sufficient amount of both the tin sulfide and molybdenum sulfide catalyst precursors will be used to provide from about 100 ppm to about 2000 ppm, most preferably about 200 ppm to about 1500 ppm, of each metal on a weight basis, based on dry, ash-free carbonaceous material. The amount of each metal actually added will, of course, be reduced by the concentration of that metal in active form actually recycled in any recycled stream. Similarly, a sufficient amount of iodine will be added, in a preferred embodiment, to provide from about 100 ppm to about 2000 ppm, most preferably from about 500 ppm to about 1500 ppm, iodine, on a weight basis, based on dry, ash-free carbonaceous material and, again, the amount actually introduced will be reduced by the amount of useful (active) iodine contained in any of the recycled streams.

A single stage embodiment of the present invention is illustrated in FIG. 1 and it is believed that the invention will be better understood by reference to this figure. Referring then to FIG. 1, a carbonaceous feed material, preferably a coal, is introduced into slurry preparation vessel 110 through 111. As indicated supra, and when a solid carbonaceous material is used, the solid carbonaceous material will be finely divided with suitable means not illustrated when it is introduced into the slurry preparation of vessel 110. In the slurry preparation vessel, the carbonaceous material is combined with a tin sulfide or tin sulfide precursor either alone or in combination with one or more other metal sulfides, which in the embodiment illustrated, may be introduced through line 112. In the embodiment illustrated, the tin and any other metal sulfides or precursors thereof have been previously combined with a suitable process diluent or solvent such as in mixing vessel 113. In the embodiment illustrated, the suitable process diluent or solvent is introduced into mixing vessel 113 through lines 114—114 while the tin and any other metal sulfide or precursors thereof are introduced into mixing vessel 113 through lines 115—115. As indicated supra, the tin sulfide or a precursor thereof may be dissolved in a suitable solvent such as water or an alcohol prior to introduction into vessel 113. Similarly, any other metal sulfide or precursor thereof that may be used may also be dissolved in a solvent such as an alcohol prior to introduction into vessel 113. Generally, agitating means such as agitator 116 may be provided in mixing vessel 113 to insure good distribution of the tin sulfide or tin sulfide precursor and any other metal sulfide or metal sulfide precursor in the solvent. The mixing vessel may be operated at any suitable temperature. When one or more soluble precursors are used, however, the temperature may be increased to insure that said precursors are dissolved in the solvent as the mixture is withdrawn through line 117 and passed into line 112. It will, of course, be appreciated that when the tin sulfide or tin sulfide precursor and any other metal sulfide or metal sulfide precursor that may be used are not mixed with a suitable process diluent or solvent prior to feeding the same to slurry preparation vessel 110, the sulfides or precursor thereof, may be fed directly into line 112 from line 115 through line 118. In embodiments such as these, the process diluent or solvent may be introduced into preparation vessel 110 through line 119. Moreover, and even when the sulfide or sulfide precursors are premixed with process solvent or diluent, additional process solvent may be introduced into slurry preparation vessel 110 through line 119. Moreover the solvent introduced through line 119 may be different from the solvent introduced through line 114. To insure the preparation of a relatively uniform slurry of solid carbonaceous material, when a solid carbonaceous material is processed, recycled bottoms, sulfide or sulfide precursors and diluent or solvent, slurry preparation vessel 110 may comprise suitable agitation means such as agitator 120. Generally, the slurry preparation vessel 110 will be operated at conditions suitable for the preparation of a satisfactory slurry and, in any case, at a temperature sufficient to insure that the sulfide precursor or precursors, when precursors are employed, remains dissolved either in the carbonaceous material feedstock or in the diluent or solvent. In general, iodine ($I_2$), hydrogen iodide (HI) or a suitable iodine precursor may be added to the slurry in slurry preparation vessel 110. This may be accomplished by passing the iodine ($I_2$), hydrogen iodide (HI) or suitable iodine precursor into slurry preparation vessel 110 through lines 119' and 119. Alternatively, the iodine ($I_2$), hydrogen iodide (HI) or iodine precursor could be added directly to the hydroconversion zone 127. In the embodiment illustrated, this would be accomplished by introducing the iodine ($I_2$), hydrogen iodide (HI) or iodine precursor through lines 119" and 126. After the slurry has been prepared, the same will be withdrawn from the slurry preparation vessel 110 through line 121. The mixture will then be heated to a temperature at or near the hydroconversion temperature by passing the same through preheater 122. The mixture is then withdrawn through line 123 and, when a carbonaceous material containing water has been used, the mixture may be passed to flash drum 124 where at least a portion of the water, as steam, may be flashed overhead through line 125 and a slurry suitable for hydroconversion withdrawn through line 126. The slurry is then fed to hydroconversion stage or zone 127 and is combined with molecular hydrogen added through line 128. The molecular hydrogen may be preheated via means not shown in FIG. 1.

In the hydroconversion stage or zone 127, the carbonaceous material will be converted, at least in part, to gaseous and liquid products. The hydroconversion will, generally, be achieved at a temperature within the range from about 500° F. to about 1000° F. and at a total pressure within the range from about 500 psig to about 7000 psig and with a hydrogen partial pressure within the range from about 400 psig to about 5000 psig. In a preferred embodiment, the hydroconversion will be completed at a temperature within the range from about 700° F. to about 900° F. In a most preferred embodiment, the hydroconversion will be completed at a temperature within the range from about 820° F. to about 860° F. Both the preferred and most preferred embodiments will be completed at a total pressure within the range from about 1000 psig to about 3000 psig, most preferably from about 1500 psig to about 2500 psig and at a hydrogen partial pressure within the range from about 800 psig to aout 2500 psig, most preferably from about 1350 psig to about 2200 psig. Gaseous products and any unconsumed hydrogen may be withdrawn from the conversion zone through line 129. The conversion products, except any that may be withdrawn through line 129 including solvent, spent solvent and any unreacted feed, will be withdrawn from the hydroconversion stage or zone 127 through line 130.

The effluent from conversion stage or zone 127 withdrawn through line 130 is then fed to a suitable separator 131. The separator may consist of any suitable means for separating the effluent into its various fractions such as a normally gaseous fraction, a normally liquid fraction and a normally solid bottoms fraction. Suitable separation devices include, but are not necessarily limited to, knockout pots, which may be used alone or in combination with filters, centrifuges, distillation apparatus and the like. In a preferred embodiment the separation means will comprise a flash drum and a distillation apparatus comprising an atmospheric and vacuum fractionation column. In this embodiment, gaseous and lower boiling liquid will be flashed off before the remaining effluent is passed to the distillation apparatus. In this embodiment and when a distillation apparatus is employed, a light product may be withdrawn overhead through line 132 and combined with any light product previously separated. Similarly, a normally solid bottoms product which will include unconverted feed, spent and unspent catalyst and mineral matter may be withdrawn through line 133. The remaining normally liquid product may then be separated into fractions having any desired boiling range or ranges. For example, a relatively low boiling product having an initial boiling point within the range from about 32° F. to about 100° F. and a final boiling point within the range from about 350° F. to about 450° F. and boiling, generally, within the gasoline or naphtha range may be withdrawn through line 134. A higher boiling, middle distillate, fraction having an initial boiling point within the range from about 350° F. to about 450° F. and a final boiling point within the range from about 600° F. to about 700° F. may be withdrawn throuh line 135 and a still higher boiling, vacuum gas oil (VGO) fraction, having an initial boiling point within the range from about 600° F. to about 700° F. and a final boiling point within the range from about 950° F. to about 1050° F. may be withdrawn through lines 136—136.

In a preferred embodiment at least a portion of the distillate fraction having an initial boiling point within the range from about 600° F. to about 700° F. and a final boiling point within a range from about 950° F. to about 1050° F. will be recycled and used as a solvent. As indicated supra, this fraction will contain about 40 wt % to 45 wt % of the iodine introduced to the hydroconversion. The recycle may be accomplished through lines 136—136 and 135'—135' and the recycle solvent would, in the embodiment illustrated, be introduced into mixing vessel 113 through line 114. This recycle stream may also be combined with all or a portion of the middle distillate fraction withdrawn through line 135. When recycle solvent is not, however, used or when the amount of recycle available is not sufficient, extraneous solvent may be introduced into mixing vessel 113 through lines 137, 114' and 114 or to slurry preparation vessel 110 through lines 119—119. In those cases where the amount of solvent boiling range material is in excess of process needs, excess middle distillate may be withdrawn through line 135'' while excess VGO may be withdrawn through line 136', but as indicated supra, in a most preferred embodiment the vacuum gas oil fraction, if such a fraction is produced, will be recycled to extinction.

Any stream ultimately withdrawn from the separator may be used directly for many purposes such as a final product or any or all of the streams may be further upgraded to yield products of enchanced value. For example, the gaseous streams withdrawn through lines 129 and 132 may be combined, scrubbed to separate pollutants and other noncombustible materials and treated to separate molecular hydrogen so as to yield a pipeline quality gas. Similarly, the lower boiling fraction withdrawn through line 134, which boils in the naphtha or motor gasoline range, may be further upgraded to yield a high quality motor gasoline. The middle distillate fraction withdrawn through line 135 may be treated to yield a high quality fuel oil, or in some cases to yield a quality diesel fuel. The normally solid bottoms product withdrawn through line 133' may be burned directly to recover its fuel value or the same may be discarded directly, especially in those cases where the carbon content is too low to support combustion. As is well known, all or a part of the catalyst species may be separated prior to discarding or burning. Moreover, a portion of this bottoms stream could be recycled to the conversion zone 127 through line 137 to increase the concentration of catalyst, including iodine, therein, thereby decreasing the amount of makeup catalyst and iodine required.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example, four runs were completed wherein dibenzyl was simultaneously cracked and hydrogenated to a mixture of toluene, benzene and ethylbenzene. In the first run the simultaneous conversions were completed thermally at 840° F. for thirty minutes and in the presence of hydrogen at a total pressure of 2200 psig. In the second run, the simultaneous conversions were completed at the same conditions but in the presence of 1.667 g of moylybdenum naphthenate. In the third run, the simultaneous conversions, were completed at the same conditions used in Runs 1 and 2 except that 0.2085 g of zinc chloride was present. In the fourth run, the simultaneous conversions were coompleted at the same conditions used in Runs 1, 2 and 3 except that 0.1597 g of stannous chloride was present. All runs were completed in a 300 ml autoclave and 100 g of dibenzyl was charged to the autoclave at the start of each run. After each run was completed, the product was analyzed to determine the mol % of dibenzyl thermally cracked and the mol % of dibenzyl hydrocracked via a hydrogen radical mechanism. The reslts are shown in the Bar Graphs displayed in FIG. 2. As will be apparent from FIG. 2, both molybdenum naphthenate and zinc chloride significantly retard the hydrocracking reaction while stannous chloride had little effect on the hydrocracking reaction. Similarly, molybdenum naphthenate and zinc chloride retard the overall conversion while stannous chloride had little, if any, effect on the overall conversion.

EXAMPLE 2

In this example, a Monterey coal was hydroconverted or liquefied in a small continuous unit. The liquefaction was accomplished at 800° F. at a total pressure of 2000 psig and a hydrogen partial pressure of 1940 psig. Prior to being fed to the hydroconversion stage or zone, the Monterey coal was slurried with a solvent comprising 62.5 wt % of a heavy vacuum gas oil and 37.5 wt % of a hydrogenated creosote oil. The slurry feed rate to the continuous unit was 1.2 lb/hr. The nominal holding time during the liquefaction was 120 minutes. The solvent to coal ratio was maintained at 2. The heavy vacuum gas oil used in this run was produced in an earlier run completed without iodine. The coal was combined with 500 ppm molybdenum, by weight, based on dry, ash-free coal as a dibutylsubstituted dithiocarbamate of molybdenum(VI). The dibutylsubstituted dithiocarbamate of molybdenum(VI) was dissolved in methanol prior to its addition to the coal slurry. At steady state, the total conversion of coal to gaseous ($C_1$–$C_4$) and liquid hydrocarbons ($C_5$-1000° F.) was determined. Moreover, the amount of coal converted to a motor gasoline boiling range product ($C_5$-350° F.), to a middle distillate boiling range product (350° F.–650° F.) and the amount of coal converted to a vacuum gas oil boiling range product (650° F.–1000° F.) was determined. The total conversion of coal to gaseous products was 15.6 wt % (DAF), the conversion of coal to motor gasoline boiling range product was 12.3 wt % (DAF), the total conversion of coal to middle distillate boiling range product was 9.3 wt % (DAF) and the total conversion of coal to vacuum gas oil boiling range product was 29.7 wt % (DAF).

EXAMPLE 3

The run of Example 2 was repeated except that 500 ppm of tin, as stannous chloride, and 1000 ppm $I_2$, as molecular iodine was substituted for the dibutyl substituted dithiocarbamate of molybdenum(VI) used in Example 2. At steady state, the total conversion of coal to gaseous ($C_1$–$C_4$) products was 17.6 wt % (DAF) and the total conversion of coal to liquid products ($C_5$-1000° F.) was 61 wt %. The conversion of coal to $C_5$-350° F. boiling range product was 16.2 wt % (DAF), the conversion of coal to 350° F.–650° F. boiling range product was 44.9 wt % (DAF) and the conversion of coal to 650° F.–1000° F. boiling range product was 4.6%.

EXAMPLE 4

The run of Example 3 was repeated except that the temperature was raised to 825° F. At steady state, the total conversion of coal to gaseous ($C_1$–$C_4$) products was 30.5 wt % (DAF) and the total conversion of coal to liquid products ($C_5$-1000° F.) was 64 wt % (DAF). The total conversion of coal to $C_5$-350° F. boiling range product was 29.6 wt % (DAF), the total conversion of coal to 350° F.–650° F. boiling range product was 44.9 wt % and the total conversion of coal to 650° F.–1000° F. was −10.3 wt % (DAF). A comparison of this example with Example 2 reveals that the yield of $C_5$-350° F. boiling range product was nearly doubled by raising the temperature from 800° F. to 825° F. Moreover, the total yield of liquid product increased slightly even though the yield of gaseous products was up significantly. Since the yield of 650° F.–1000° F. was negative, it would be necessary to either use a portion of the 350° F.–650° F. product fraction as solvent or to use an extraneous solvent in a continuous operation at these operating conditions. The former would, of course, be preferred.

EXAMPLE 5

In this Example, a Cold Lake crude oil residuum having an initial boiling point of about 975° F. was hydroconverted in a 380 cc autoclave with a molybdenum sulfide catalyst at 830° F. and 120 minute holding time at a total pressure of 2300 psig and a hydrogen partial pressure of 1600 psig. The molybdenum sulfide catalyst was formed in situ from a dibutyl-substituted dithiocarbamate of molybdenum(VI) which was added in an amount sufficient to provide 300 ppm of molybdenum. After the run was completed, the yield of gaseous ($C_1$–$C_4$) product, $C_5$-400° F. boiling range product and 400° F.–1000° F. product were determined. These yields are shown in the Bar Graph for Example 5 in FIG. 3.

EXAMPLE 6

In this example, the run of Example 5 was repeated except that a catalyst composition comprising 200 ppm molybdenum as molybdenum sulfide, 500 ppm of tin as tin sulfide and 1000 ppm of iodine was substituted for the molybdenum sulfide catalyst used in Example 5. Both the molybdenum and tin sulfides were formed in situ from a dibutyl-substituted dithiocarbamate of molybdenum(VI) and stannous chloride, respectively. After the run was completed, the yield of gaseous ($C_1$–$C_4$) product, $C_5$-400° F. boiling range product and 400° F.–1000° F. product were determined. These yields are shown in the Bar Graph for Example 6 in FIG. 3.

EXAMPLE 7

In this example, the run of Example 5 was again repeated except that a catalyst composition comprising 500 ppm molybdenum as molybdenum sulfide, 500 ppm of tin as tin sulfide and 1000 ppm of iodine was substituted for the molybdenum sulfide catalyst used in Example 5. Both the molybdenum and tin sulfides were formed in situ from a dibutyl-substituted dithiocarbamate of molybdenum(VI) and stannous chloride, respectively. After the run was completed, the yield of gaseous ($C_1$–$C_4$) product, $C_5$-400° F. boiling range product and 400° F.–1000° F. product were determined. These yields are shown in the Bar Graph for Example 7 in FIG. 3.

EXAMPLE 8

In this example, the run of Example 5 was again repeated except that a catalyst composition comprising 500 ppm tin as stannous chloride and 1000 ppm of iodine was substituted for the molybdenum sulfide catalyst used in Example 5. The tin sulfide was formed in situ from the stannous chloride. After the run was completed, the yield of gaseous ($C_1$–$C_4$) product, $C_5$-400° F. boiling range product and 400° F.–1000° F. product were determined. These yields are summarized in the Table below:

TABLE

| Distillate Fraction | Yield, Wt % |
|---|---|
| $C_1$–$C_4$ | 9.0 |

TABLE-continued

| Distillate Fraction | Yield, Wt % |
|---|---|
| $C_5$–400° F. | 29.0 |
| 400° F.–1000° F. | 44.0 |

Comparison of the results of Examples 5, 6, and 7 with the results summarized in the preceding Table for Example 8 show that changing the metal concentrations alters the product selectivities. Tin/iodine alone gives more cracking as shown by the larger quantity of ($C_1$–$C_4$) yield. Addition of molybdenum to the tin/iodine catalyst system suppresses gas yield and increases the liquid yield. Moreover, when the amount of molybdenum was 500 ppm, the amount of $C_5$-400° F. fraction is significantly increased.

While the present invention has been described and illustrated by reference to particular embodiments thereof, it will be appreciated by those of ordinary skill in the art that the same lends itself to variations not necessarily illustrated herein. For this reason, then, reference should be made solely to the dependent claims for purposes of determining the true scope of the present invention.

Having thus described and illustrated the invention, what is claimed is:

1. An improved process for hydroconverting carbonaceous materials comprising:

(a) contacting a carbonaceous material with hydrogen at an elevated temperature and pressure in the presence of a catalyst comprising tin and in the presence of iodine, which iodine may be present as hydrogen iodide;

(b) continuing the contacting of step (a) for a sufficient period of time to convert at least a portion of said carbonaceous material to a liquid product; and (c) recovering a liquid product from the effluent of step (a).

2. The process of claim 1 wherein the contacting is accomplished at a temperature within the range from about 500° F. to about 1000° F. at a total pressure within the range from about 500 psig to about 7000 psig and at a hydrogen partial pressure within the range from about 400 psig to about 5000 psig.

3. The process of claim 2 wherein said carbonaceous material is a normally solid carbonaceous material.

4. The process of claim 3 wherein said contacting is accomplished in the presence of a solvent.

5. The process of claim 4 wherein at least a portion of said solvent is a distillate fraction separated from the liquid product.

6. The process of claim 5 wherein that portion of the solvent separated from the liquid product has an initial boiling point within the range from about 600° F. to about 700° F. and a final boiling point within the range from about 950° F. to about 1050° F.

7. The process of claim 2 wherein the concentration of tin is within the range from about 10 ppm to about 5,000 ppm and the concentration of iodine is within the range from about 10 ppm to about 5,000 ppm, both based on dry, ash-free solid carbonaceous material.

8. The process of claim 7 wherein said tin is present at the concentration within the range from about 100 ppm to about 2000 ppm and the iodine is present at a concentrate within the range from about 100 ppm to about 2000 ppm and wherein the weight ratio of iodine to total metal is within the range from about 0.5:1 to about 10:1.

9. The process of claim 2 wherein the effluent from step (a) is separated at least into a liquid product and a normally solid bottoms product and at least a portion of said normally solid bottoms product is recycled to step (a).

10. The process of claim 9 wherein from about 50 wt % to about 90 wt % of said bottoms product is recycled to step (a).

11. The process of claim 1 wherein said contacting is accomplished at an initial temperature within the range from about 820° F. to about 860° F. at a total pressure within the range from about 1000 psig to about 3000 psig and with a hydrogen partial pressure within the range from about 800 psig to about 2500 psig.

12. The process of claim 2 wherein said tin is added as a hydrocarbyl-substituted dithiocarbamate.

13. The improved process of claim 12 wherein said dithiocarbamate contains iodine.

14. The process of claim 1 wherein said tin and the iodine are each present at a concentration within the range from about 200 ppm to about 1500 ppm, by weight, based on dry, ash-free solid carbonaceous material.

15. An improved process for hydroconverting carbonaceous materials comprising:

(a) contacting a carbonaceous material with hydrogen at an elevated temperature and pressure in the presence of a catalyst comprising tin and at least one other metal selected from the Group of metals consisting of the Groups IV-B, V-A, VI-A, VII-A and Group VIII-A metals of the Periodic Table of the Elements and in the presence of iodine, which iodine may be present as hydrogen iodide;

(b) continuing the contacting of step (a) for a sufficient period of time to convert at least a portion of said carbonaceous material to a liquid product; and (c) recovering a liquid product from the effluent of step (a).

16. The process of claim 15 wherein the contacting is accomplished at a temperature within the range from about 500° F. to about 1000° F. at a total pressure within the range from about 500 psig to about 7000 psig and at a hydrogen partial pressure within the range from about 400 psig to about 5000 psig.

17. The process of claim 16 wherein said carbonaceous material is a normally solid carbonaceous material.

18. The process of claim 17 wherein said contacting is accomplished in the presence of a solvent.

19. The process of claim 18 wherein at least a portion of said solvent is a distillate fraction separated from the liquid product.

20. The process of claim 19 wherein that portion of the solvent separated from the liquid product has an initial boiling point within the range from about 600° F. to about 700° F. and a final boiling point within the range from about 950° F. to about 1050° F.

21. The process of claim 16 wherein the concentration of tin and said other metal is within the range from about 10 ppm to about 5,000 ppm and the concentration of iodine is within the range from about 10 ppm to about 5,000 ppm.

22. The process of claim 21 wherein said tin and said other metal is present at the concentration within the range from about 100 ppm to about 2000 ppm and the iodine is present at a concentrate within the range from about 100 ppm to about 2000 ppm and wherein the weight ratio of iodine to metal is within the range from about 0.5:1 to about 10:1.

23. The process of claim 16 wherein the effluent from step (a) is separated at least into a liquid product and a normally solid bottoms product and at least a portion of said normally solid bottoms product is recycled to step (a).

24. The process of claim 23 wherein from about 50 wt % to about 90 wt % of said bottoms product is recycled to step (a).

25. The process of claim 15 wherein said contacting is accomplished at an initial temperature within the range from about 820° F. to about 860° F. at a total pressure within the range from about 1000 psig to about 3000 psig and with a hydrogen partial pressure within the range from about 800 psig to about 2500 psig.

26. The improved process of claim 15 wherein said other metal is molybdenum.

27. The process of claim 26 wherein said tin and said other molybdenum are added as a hydrocarbyl-substituted dithiocarbamate.

28. The process of claim 15 wherein said tin and said other metal and the iodine are each present at a concentration within the range from about 200 ppm to about 1500 ppm, by weight, based on dry, ash-free solid carbonaceous material.

29. The process of claim 22 wherein the weight ratio of tin to other metal is within the range from about 0.1:1 to about 10:1.

30. The process of claim 27 wherein the tin dithiocarbamate contains iodine.

31. The process of claim 28 wherein said other metal is molybdenum.

32. The process of claim 31 wherein the weight ratio of iodine and tin plus molybdenum is within the range from about 1:1 to about 5:1 and the weight ratio of tin to molybdenum is within the range from about 0.5:1 to about 5:1.

33. The process of claim 3 wherein said contacting is accomplished at an initial temperature within the range from about 820° F. to about 860° F. at a total pressure within the range from about 1000 psig to about 3000 psig and with a hydrogen partial pressure within the range from about 800 psig to about 2,500 psig.

34. The process of claim 17 wherein said contacting is accomplished at an initial temperature within the range from about 820° F. to about 860° F. at a total pressure within the range from about 1000 psig to about 3000 psig and with a hydrogen partial pressure within the range from about 800 psig to about 2,500 psig.

* * * * *